US008176690B2

(12) United States Patent
Stanley

(10) Patent No.: US 8,176,690 B2
(45) Date of Patent: May 15, 2012

(54) HIGH-STRENGTH STRUCTURE

(76) Inventor: Newman Stanley, Jacksonville, FL (US)

( * ) Notice: Subject to any disclaimer, the term of this patent is extended or adjusted under 35 U.S.C. 154(b) by 0 days.

(21) Appl. No.: 12/834,425

(22) Filed: Jul. 12, 2010

(65) Prior Publication Data

US 2011/0162306 A1 Jul. 7, 2011

Related U.S. Application Data

(63) Continuation-in-part of application No. 12/012,400, filed on Feb. 1, 2008, now abandoned.

(60) Provisional application No. 60/898,916, filed on Feb. 1, 2007.

(51) Int. Cl.
*E04B 7/04* (2006.01)

(52) U.S. Cl. ..... 52/93.2; 52/274; 52/293.3; 52/94

(58) Field of Classification Search ..... 52/272, 52/270, 274, 278, 281, 309.1, 309.2, 292, 52/94, 92.2, 93.2, 93.1, 90.1, 91.1, 293.3
See application file for complete search history.

(56) References Cited

U.S. PATENT DOCUMENTS

| | | | | | |
|---|---|---|---|---|---|
| 2,050,609 | A | | 8/1936 | Howell | |
| 2,584,626 | A | | 2/1952 | Sherron | |
| 3,124,222 | A | | 3/1964 | Mote | |
| 3,160,987 | A | * | 12/1964 | Pinkley | 52/95 |
| 3,196,499 | A | | 7/1965 | Houvener | |
| 3,206,903 | A | | 9/1965 | Johnson | |
| 3,236,014 | A | | 2/1966 | Norman | |
| 3,293,808 | A | * | 12/1966 | Duncan | 52/92.2 |
| 3,327,441 | A | | 6/1967 | Kelly | |
| 3,327,442 | A | | 6/1967 | Hermann | |
| 3,415,019 | A | | 12/1968 | Andersen | |
| 3,500,597 | A | | 3/1970 | McKenzie | |
| 3,611,653 | A | | 10/1971 | Zinn | |
| 3,623,288 | A | | 11/1971 | Horowitz | |
| 3,665,662 | A | * | 5/1972 | Timbrook et al. | 52/210 |
| 3,815,302 | A | * | 6/1974 | Monroe | 52/94 |
| 4,005,556 | A | * | 2/1977 | Tuomi | 52/93.2 |
| 4,261,143 | A | * | 4/1981 | Rizzo | 52/16 |
| 2,137,767 | A | | 11/1983 | Betcone | |
| 4,611,443 | A | * | 9/1986 | Jorgensen et al. | 52/95 |
| 5,497,589 | A | * | 3/1996 | Porter | 52/309.7 |
| 5,743,056 | A | * | 4/1998 | Balla-Goddard et al. | 52/309.11 |
| 5,970,672 | A | * | 10/1999 | Robinson | 52/270 |
| 5,992,110 | A | * | 11/1999 | Clear | 52/271 |
| 6,205,729 | B1 | * | 3/2001 | Porter | 52/309.7 |
| 6,256,960 | B1 | * | 7/2001 | Babcock et al. | 52/592.1 |
| 6,298,619 | B1 | * | 10/2001 | Davie | 52/293.3 |

(Continued)

*Primary Examiner* — Robert Canfield
*Assistant Examiner* — Babajide Demuren
(74) *Attorney, Agent, or Firm* — Stephen E. Kelly; Thomas C. Saitta; Rogers Towers, P.A.

(57) ABSTRACT

A high strength, lightweight building structure comprising a high-strength connection to a foundation, high-strength eaves, and high-strength structural panels. The fiber reinforced, high-strength structural panels form the walls, ceiling, roof, soffit, and eave of the structure. The panels comprise a rigid foam core having outer membrane layer, panel spacers, and sheeting. The high-strength foundation connection comprises a continuous seam plate with bonding agents, mechanical fasteners, and a metal bearing cap having continuously spaced, angle-shaped anchor studs welded to the metal bearing cap. The high-strength eave structure, comprise of a soffit panel connected to an inclined eave panel, a connection bracket and a rigid wedge continuously bonded between the ceiling panel and roof panel, thus forming a sealed, non-vented attic space.

4 Claims, 11 Drawing Sheets

U.S. PATENT DOCUMENTS

| | | | | |
|---|---|---|---|---|
| 6,907,695 | B2 * | 6/2005 | Pierce | 52/66 |
| 2002/0139080 | A1 * | 10/2002 | Thompson | 52/708 |
| 2003/0033769 | A1 * | 2/2003 | Record | 52/270 |
| 2004/0187414 | A1 * | 9/2004 | Brochu | 52/272 |
| 2006/0026907 | A1 * | 2/2006 | Gilstrap et al. | 52/92.2 |
| 2007/0125042 | A1 * | 6/2007 | Hughes et al. | 52/782.1 |

* cited by examiner

HIGH-STRENGTH STRUCTURE

This application is a continuation-in-part of U.S. patent application Ser. No. 12/012,400, filed on Feb. 1, 2008, now abandoned which received the benefit of U.S. Provisional Patent Application Ser. No. 60/898,916, filed on Feb. 1, 2007.

BACKGROUND OF THE INVENTION

The present invention relates generally to high-strength structural systems and components for residential and light commercial buildings, and more specifically to high-strength structural components for eaves, wall panels, ceiling panels, and roof panels. Also included are methods of attaching the components together, thereby forming a high strength integrated structure or enclosure.

In recent years, hurricanes have caused billions of dollars in damage by decimating many homes in the coastal regions of the Carolinas and Gulf states. The destruction is caused by high wind forces and flooding due to excessive rain and high storm surges. A survey of the damage indicates that the wind velocities reached or exceeded 200 miles per hour in many areas. Follow up cost estimates by local officials revealed staggering tax burden to provide temporary shelter for habitants of destroyed homes, and to provide emergency repair of damaged homes. The destruction has been so prolific that some of the largest insurance companies no longer offer new homeowner policies in coastal states. Moreover, recent earthquake events have resulted in a devastating loss of life and property destruction where homes and buildings lack the shear strength to with stand even earthquakes of average magnitude.

These recent wind and seismic events show that better low-cost, lightweight enclosure units are needed to survive the ultimate forces expected from both seismic and wind force loads. It is known that in extreme seismic events, low mass and high shear strength greatly reduce structural damage, and both of these characteristics promote improved structural performance under extreme wind loads.

To address these problems, the present invention is directed to residential and light to medium commercial enclosure design and construction methods that would survive the forces developed in extreme climatic conditions, thus offering significant savings to the owners, taxpayers, and insurance companies.

SUMMARY OF THE INVENTION

The high-strength structural system comprises a high-strength connection to a foundation, high-strength eaves, and high-strength structural panels. In the high-strength structural system, all panels for the walls, ceiling, roof, soffit, and eave comprise the high-strength, fiber reinforced, laminated composite panels. The typical panels, which comprise a rigid foam core 1 having outer membrane layer, panel spacers, and sheeting. Generally, the panels are connected to the panel spacers by a bonding agent, which is also applied to bond the sheeting and the foam core together and to the panel space. The sheeting, membrane layer, rigid foam core, and panel spacers combine to form a laminated-style panel. The panel spacers are primarily used for dimensional control of the panels, and for attachment of doors, windows, and adjacent panels or structures. In many embodiments, the panel spacers are cold formed steel studs or other such lightweight, rigid members.

The fiber-reinforced membrane layer comprises a roving member that is cured and continuously bonded over the entire surface of the rigid foam core. The outer membrane layer is coated with a continuous and uniform application of a resin based, high-strength bonding agent. The bonding agent is formed by using a resin with a polymer base with water as the solvent. This resin will emit no noxious odor or toxic fumes, and when it is cured, the resin will form a vapor-tight barrier on the panel. The resin-based bonding agent is uniformly and continuously applied over the surface of the rigid foam core to create a uniform bond between the fiber-reinforced membrane layer and the rigid foam core, forming a rigid composite panel.

The sheeting may be interior or exterior to the structure. For example, interior sheeting could be the drywall facing the interior of a room in the structure. Regardless of the application of the panel, the sheeting should be selected to meet the building code requirements and to generate the proper resistance to fire, wood destroying organisms, mold and rot.

Throughout the structure, the panels are placed at a vertical orientation to form walls. A high-strength "T" connection of the external and internal walls comprises two rows of threaded fasteners connected to a rivnut providing a clamping force to both the outer layer and inner layer of the panel spacers. A compression sleeve is used to brace the panel spacers against the compression force generated by the fasteners. A high-strength "L" corner connection of two walls using the same method, except with one row of fasteners instead of two rows. In embodiments having metal components, a bonding agent can be applied in areas of metal-to-metal contact to make the connection strong, leak tight, and rigid.

The high-strength foundation connection of the walls to the foundation. This connection comprises a continuous seam plate with bonding agents, mechanical fasteners, and a metal bearing cap having continuously spaced, angle-shaped anchor studs welded to the metal bearing cap. When the foundation is poured or cured, the bearing cap is placed continuously around the edge of the uncured foundation slab to assure sufficiently uniform and consistent wall to floor contact. The wall, which has a panel spacer at the bottom of the wall, is bonded to the bearing cap via the high-strength bonding agent. Preferably, the bonding agent should also provide corrosion protection where steel is used as a panel spacer in the wall. After the wall is bonded to the bearing cap, the continuous seam plate is placed over the wall and foundation and attached via mechanical fasteners and additional bonding agents.

In the high-strength eave structure, the ceiling panel bears on the top of the wall panel, and the roof panel connects to ceiling via an angled connection bracket. A rigid wedge is snugly disposed between and bonded to the ceiling and roof panels. The wedge is bonded between these panels by the bonding agent, and the wedge and plate connect the wall panel to both the ceiling and roof panels. Since the wedge is continuously bonded to the ceiling and roof panels around the perimeter of the structure, the attic becomes a sealed, non-vented space, as described below.

The high-strength eave is comprised of a horizontal soffit panel connected to an inclined eave panel, thus forming a triangular truss. The interface between the soffit and eave panels can have a continuous sheet metal cap to protect and further strengthen the soffit and roof panel connection and to enhance the resistance of the roof sheeting to be lifted by the wind forces. The soffit panel connects to the top of the wall, and the inclined eave panel connects to the roof via the inclined portion of the connection bracket.

Thermal analysis of a prototype structure in Florida showed a 30% reduction in the cooling and heating requirements in the sub-tropic environment.

DETAILED DESCRIPTION OF THE INVENTION

Figure 1:
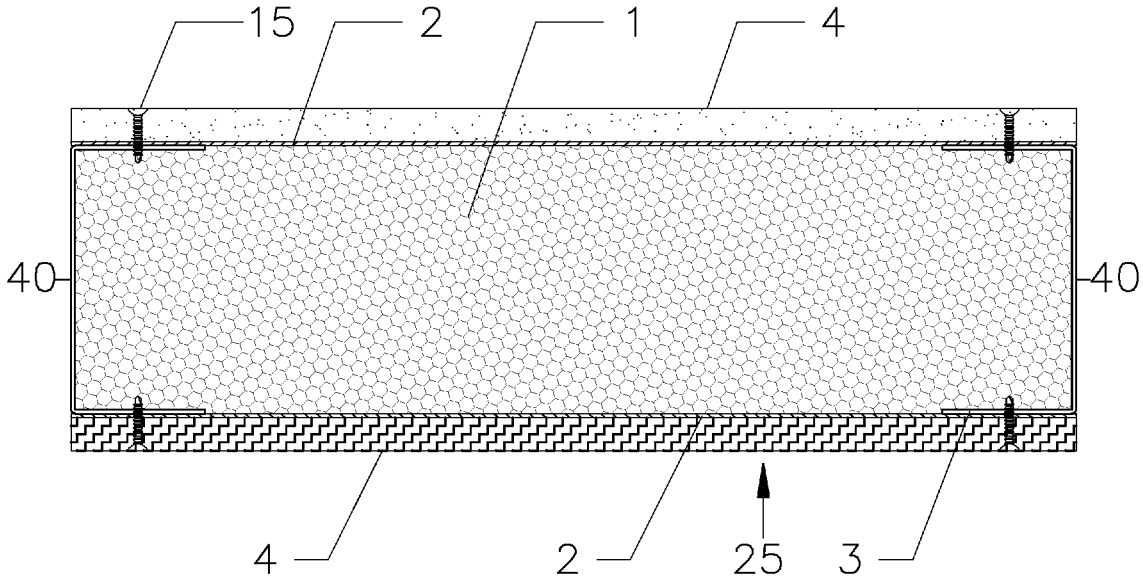
FIG. 1 is an cross section of a typical fiber reinforced, high-strength structural panel used in the wall, ceiling, roof, soffit, and eave panels.

With reference to the drawings, the invention will now be described with regard for the best mode and the preferred embodiment. In general, the invention comprises an integrated, high strength, lightweight building structure to withstand extreme loading events, such as flooding, seismic events measuring 8.0 on the Richter scale, and wind loads resulting from winds up to 250 miles per hour (Fujita Scale IV Tornado). In addition, the building structure is constructed from materials that resist wood destroying organisms, mildew, mold, rot, fire, and water damage.

The high-strength structural system comprises a high-strength connection to a foundation 11, high-strength eaves, and high-strength structural panels 25. In the high-strength structural system, all panels for the walls 26, ceiling 27, roof 28, soffit 29, and eave 30 comprise the high-strength, fiber reinforced, laminated composite panels 25 discussed below. The foundation 11 can be any firm, stable surface, such as a concrete slab or even the panels 25 placed in a suitable arrangement. For simplicity, the following discussion will contemplate a concrete slab foundation. However, the high-strength structural system is not limited to this type of foundation.

Figure 1A:
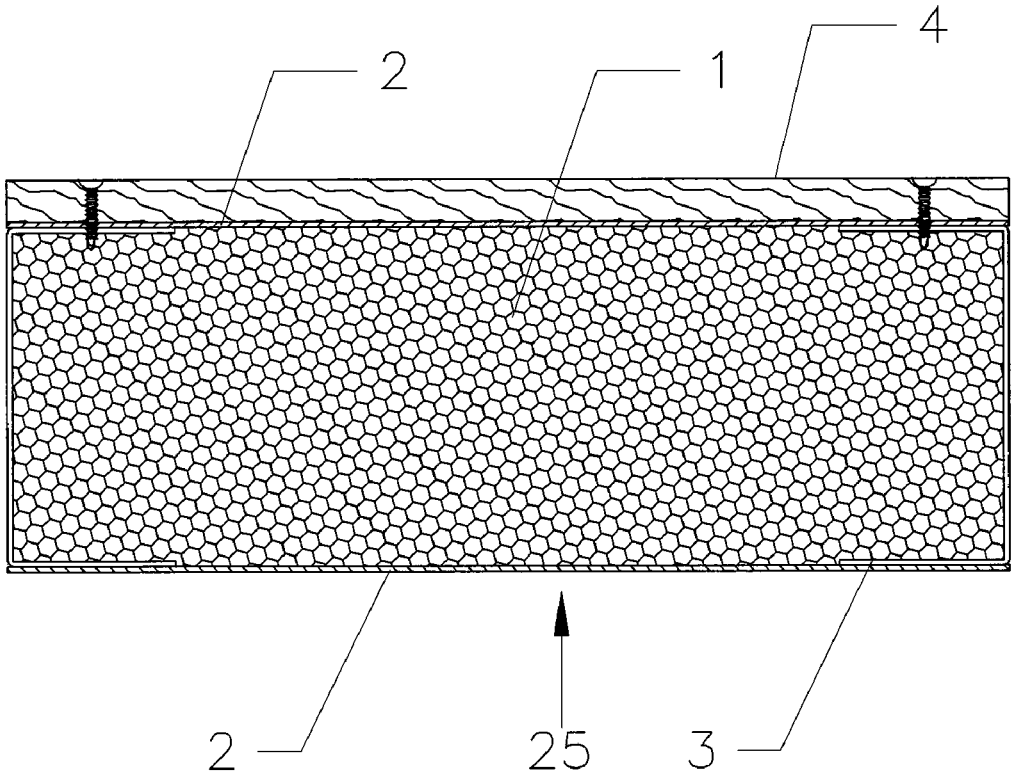
FIG. 1A is a cross section of an alternative embodiment of a fiber reinforced, high-strength structural panel used in the wall, ceiling, roof, soffit, and eave panels.

The high-strength panels 25 are typically prefabricated, although they may be fabricated and assembled at a job site. The panels 25 are used for interior and exterior walls 26, floor panels, a ceiling 27, a roof 28, a soffit 29, and an eave 30. FIGS. 1 and 1A show the typical panels 25, which comprise a rigid foam core 1 having outer membrane layer 2, panel spacers 3, and sheeting 4. Generally, the panels 25 are connected to the panel spacers 3 by a bonding agent, which is also applied to bond the sheeting 4 and the foam core 1 together and to the panel spacer 3. This method of bonding produces a stronger, vapor tight, thermally efficient composite panel 25. Preferably, rigid foam core 1 is injected between the panel spacers 3 of the panel 25 and allowed to cure in place. As another alternative, the foam 1 can be precast and placed within the composite wall. Either way, the sheeting 4, membrane layer 2, rigid foam core 1, and panel spacers 3 combine to form a laminated-style panel 25.

The panel spacers 3 may be located at any spacing, but preferably at a uniform distance such as 24 inches on center or less. The panel spacers 3 are primarily used for dimensional control of the panels 25, and for attachment of doors, windows, and adjacent panels 25 or structures. In many embodiments, the panel spacers 3 are cold formed steel studs or other such lightweight, rigid members, and in these embodiments the panel spacers 3 provide additional structural support to the panels 25.

The fiber-reinforced membrane layer 2 comprises a roving member that is cured and continuously bonded over the entire surface of the rigid foam core 1. The roving member can be glass, carbon, metal, aramid, and other materials, depending on cost and weight limits to the design. The outer membrane layer 2 is coated with a continuous and uniform application of a resin based, high-strength bonding agent. As used herein, a "bonding agent" refers to a high-strength bonding agent capable of resisting at least 200 pounds of tensile force per square inch of bonded area. Many resins commonly used with fiber-reinforced foam are not suitable for residential application because these resins emit noxious odors or toxic fumes. However, the recent development of non-toxic, high-strength resins now allow the use of high-strength bonding agents for laminated panels used in residential applications. To construct the panels 25 herein, the bonding agent is formed by using a resin with a polymer base with water as the solvent. This resin will emit no noxious odor or toxic fumes, and when it is cured, the resin will form a vapor-tight barrier on the panel. One such resin is swifttak PA317, available from Forbo Adhesive, LLC.

The resin-based bonding agent is uniformly and continuously applied over the surface of the rigid foam core 1 to create a uniform bond between the fiber-reinforced membrane layer 2 and the rigid foam core 1. The continuous bond prevents buckling of the membrane layer 2 and develops the full advantage of the membrane strength. When the bonding agent cures, it creates a vapor barrier over the panel, thus promoting the water resistant characteristics of the high-strength structure.

The sheeting 4 on the exterior of the panel 25 can be attached to the panel by a variety of means. For example, the means for attaching the sheeting 4 to the panel 25 could include sheeting fasteners 15, application of a bonding agent, or the use of other adhesive materials, such as glue, epoxy, drywall, or the like. The sheeting 4 may be interior or exterior to the structure. For example, interior sheeting 4 could be the drywall facing the interior of a room in the structure. Sheeting 4 exterior to the structure will be exposed to environmental elements and should be selected accordingly. Exterior sheeting 4 may include vinyl siding or other suitable architectural siding. In roof applications, the exterior sheeting 4 of the roof 28 is a metal roof cover or other roofing material, such as shingles, slate, tile, polymer, carbon fiber or other roofing material. In floor applications, the interior sheeting 4 is modified to be a flooring surface, such as linoleum, carpet, or other flooring material.

Regardless of the application of the panel 25, the sheeting 4 should be selected to meet the building code and exposure requirements and to generate the proper resistance to fire, impact, heat transfer, wood destroying organisms, mold and rot. Use of these materials will reduce the health concerns and cost of materials used in other conventional residential, commercial, or military structures, as well as the time and expense of building maintenance and pesticide application. This is especially true in the southeastern United States or any environment with warm temperatures and high relative humidity.

In strength testing in the structures laboratory at the University of North Florida, load-testing was performed on panels 25 using standard 20 gage steel stud panel spacers 3 and the arrangement of the rigid foam core 1 and membrane layer 2 shown in FIG. 1. The test panel 25 was 2 feet wide with an 8-foot span and a 4 inch thickness. This panel was loaded with 2000 pounds of sandbags, or 140 pounds per square foot, which is almost three times the normal design load for residential floors. After removal of the 2000-pound load, the panels fully recovered the ½-inch deflection experienced under the load, thus demonstrating that under the 2000-pound load, the stress levels in the panel 25 remained in the elastic range with no appreciable plastic deformation of the panel.

In further testing, shear resistance tests have shown panel 25 shear strengths of more than 3000 pounds per linear foot. This exceeds the strength criteria necessary to resist the forces resulting from an 8.0 seismic event. In another test, a racking force of 8000 foot-pounds was applied to a 2-foot wide panel 25, and the test results showed no appreciable deformation of the panel 25 under this load. These test results corroborate the theoretical strength predictions for the panel 25 and its unique arrangement of the roaming fibers and the location, content, and effectiveness of the resin bonding agent.

In one embodiment, the rigid foam core 1 can be bonded to the panel spacer 3 in a manner that enhances the buckling strength of the panel spacer 3 due to the lateral support provided to the panel spacer 3 by the rigid foam core 1. Finite element analysis of a steel panel spacer 3 (20 gage steel with a 3½ inch to 4 inch web) shows the failure by elastic buckling at stress levels of 10 kips per square inch. Additional analysis showed that when the bonding agent is used to bond to the web of the panel spacer 3 to the composite rigid foam core 1 and membrane layer 2, the elastic buckling stress levels in the panel spacer 3 surpass 35 kips per square inch. Further increases will result where the composite rigid foam core 1 and membrane layer 2 are bonded to the 20 gage steel flange of the panel spacer 3.

Throughout the structure, the panels 25 are placed at a vertical orientation to form walls 26. For ease of fabrication and connectivity, a panel spacer 3 is placed at the exterior of each panel 25 in a manner forming a connection interface 40, as shown in FIG. 1. The connection between adjacent panels 25, or other structural elements, is accomplished by using either mechanical fasteners 15 or bonding agents, or both, to attach the connection interface 40 of the exterior panel spacer 3 to an adjacent structural element, whether it be an adjacent panel, a foundation 11, or a connection plate, or the like.

Figure 2:
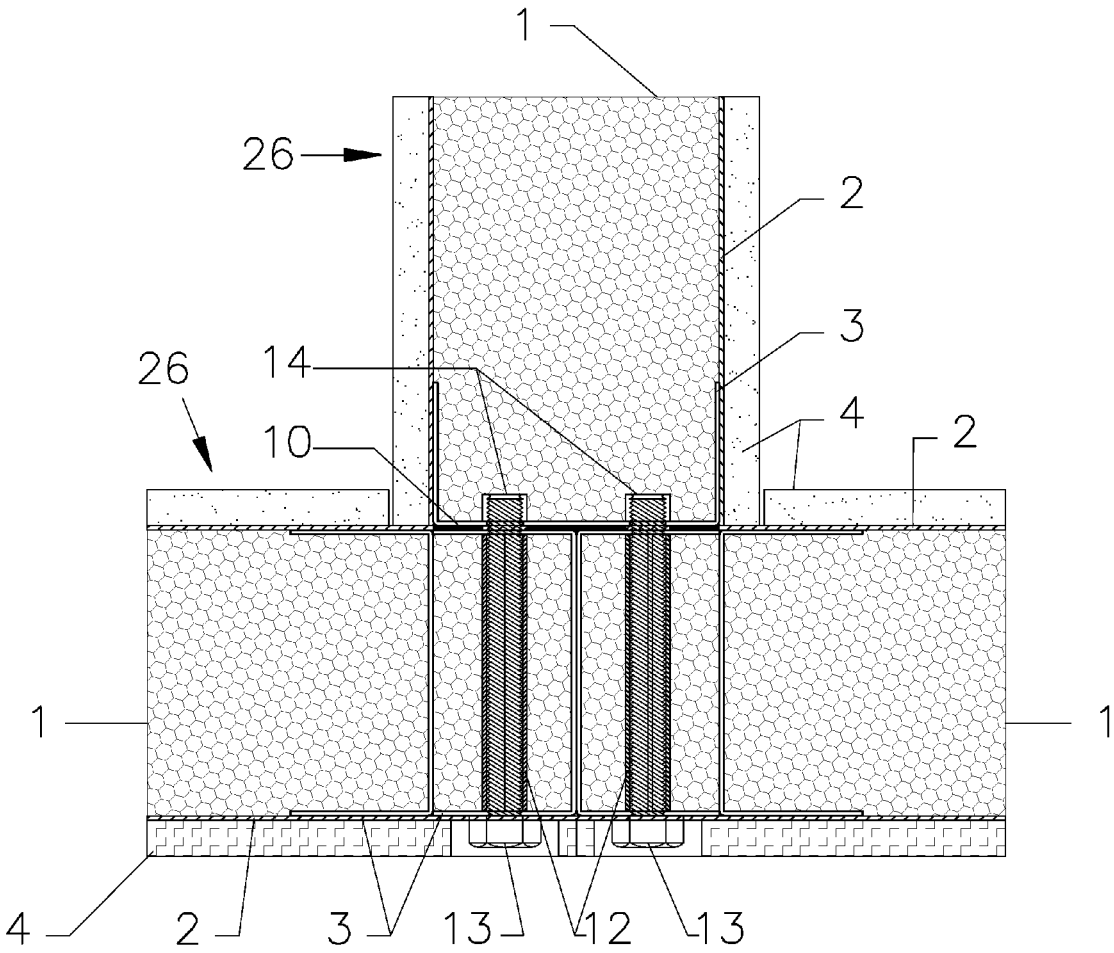
FIG. 2 is a cross section of a high-strength "T" joint between the high-strength panels.
Figure 3:
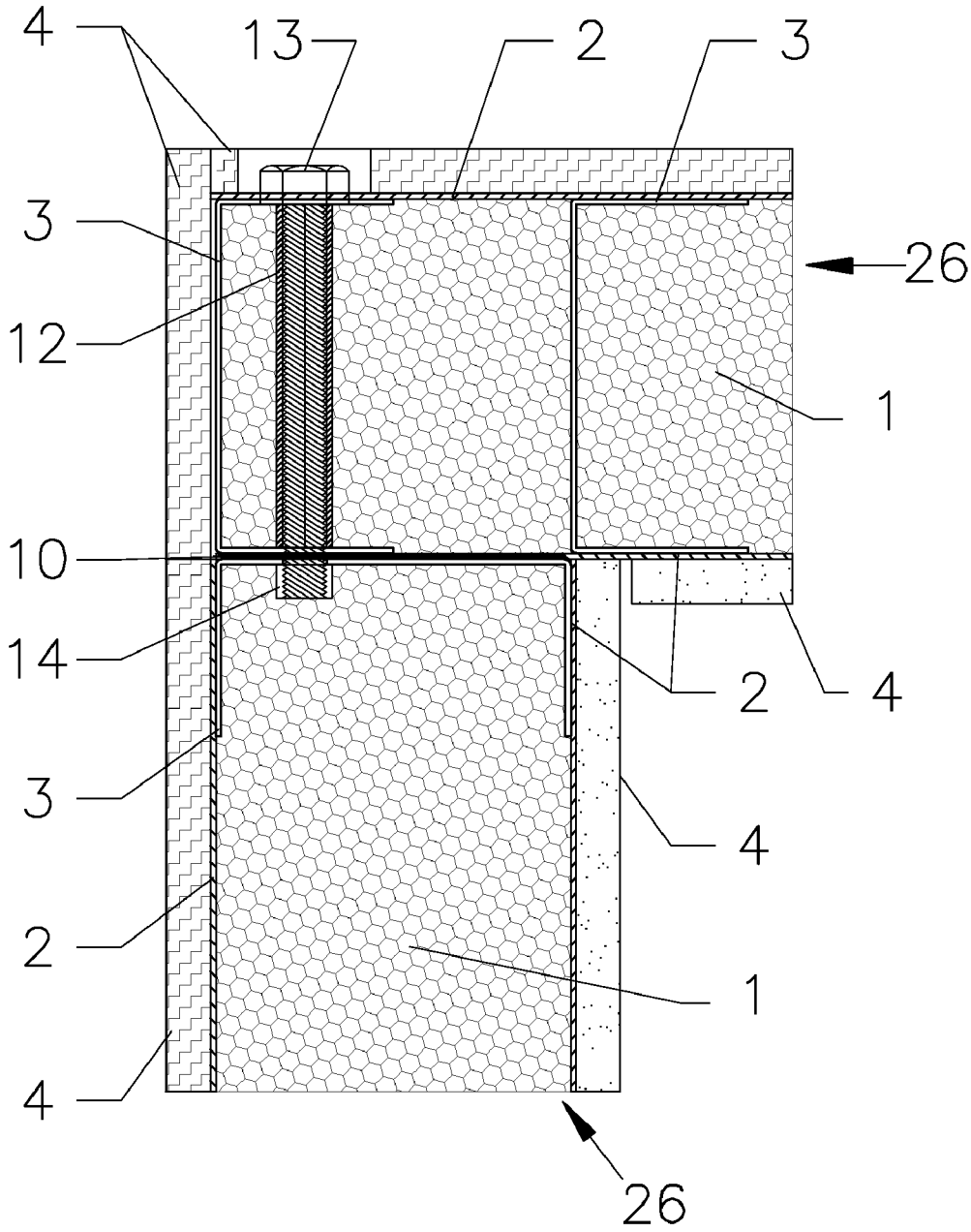
FIG. 3 is cross section of a high-strength "L" joint between the high-strength panels.
Figure 4:
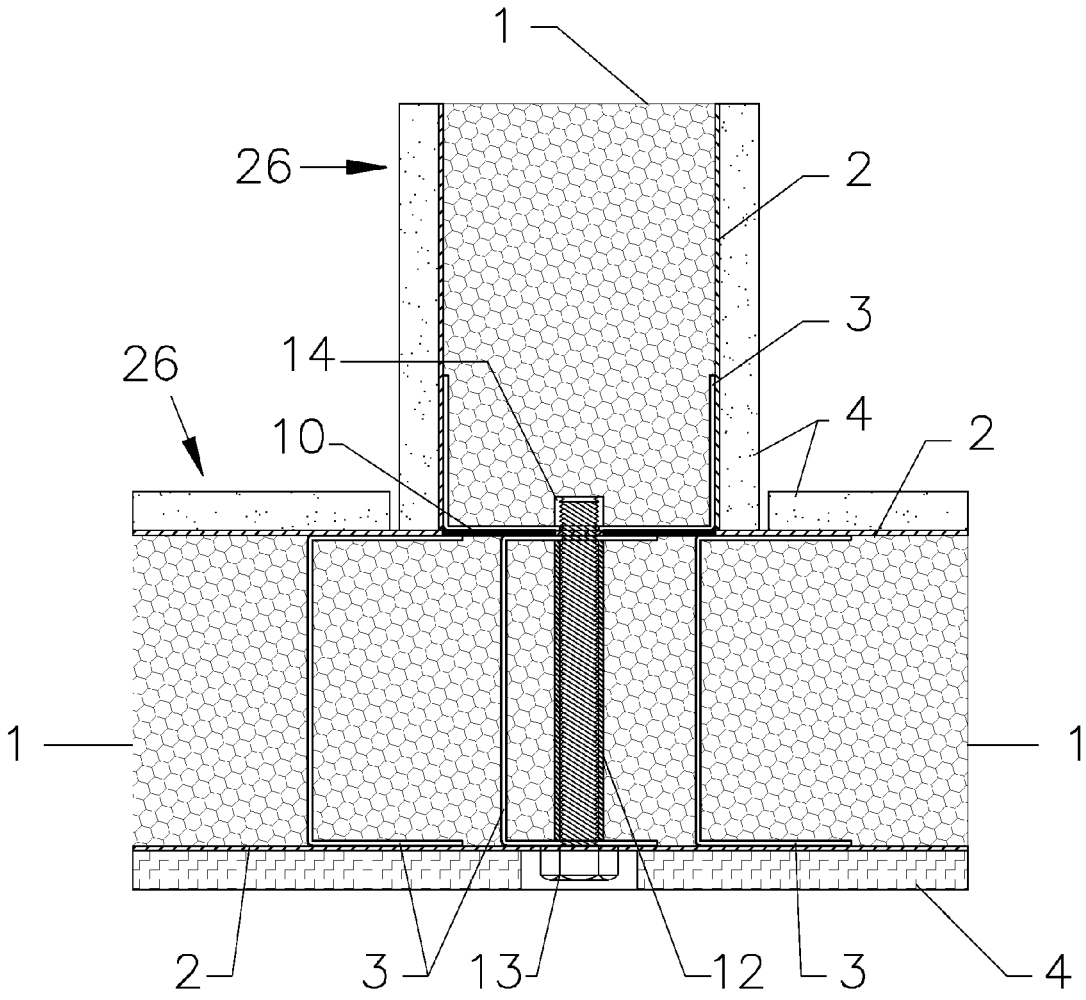
FIG. 4 is a cross section of an alternative embodiment of a high-strength "T" joint between the high-strength panels.
Figure 5:
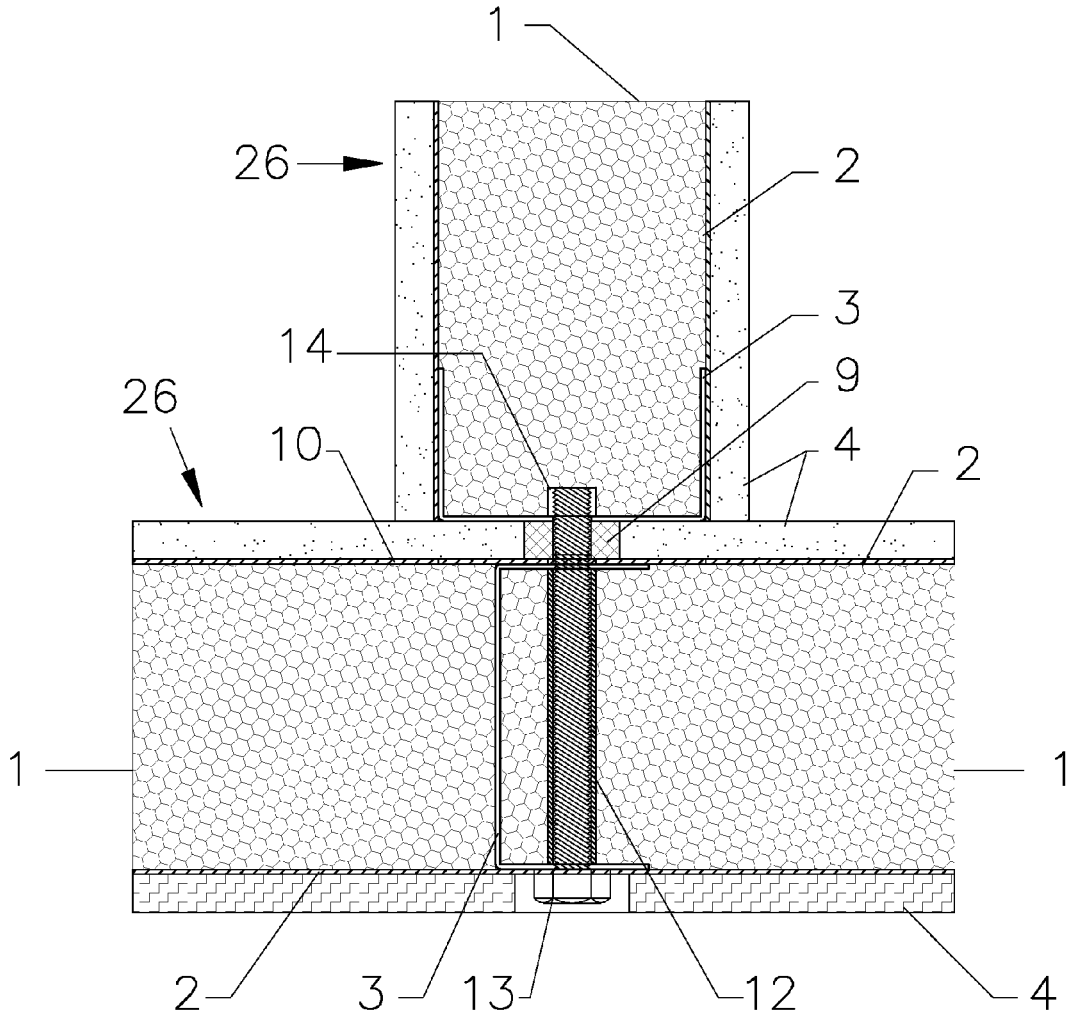
FIG. 5 is a cross section of an alternative embodiment of a "T" joint between the high-strength panels.
Figure 6:
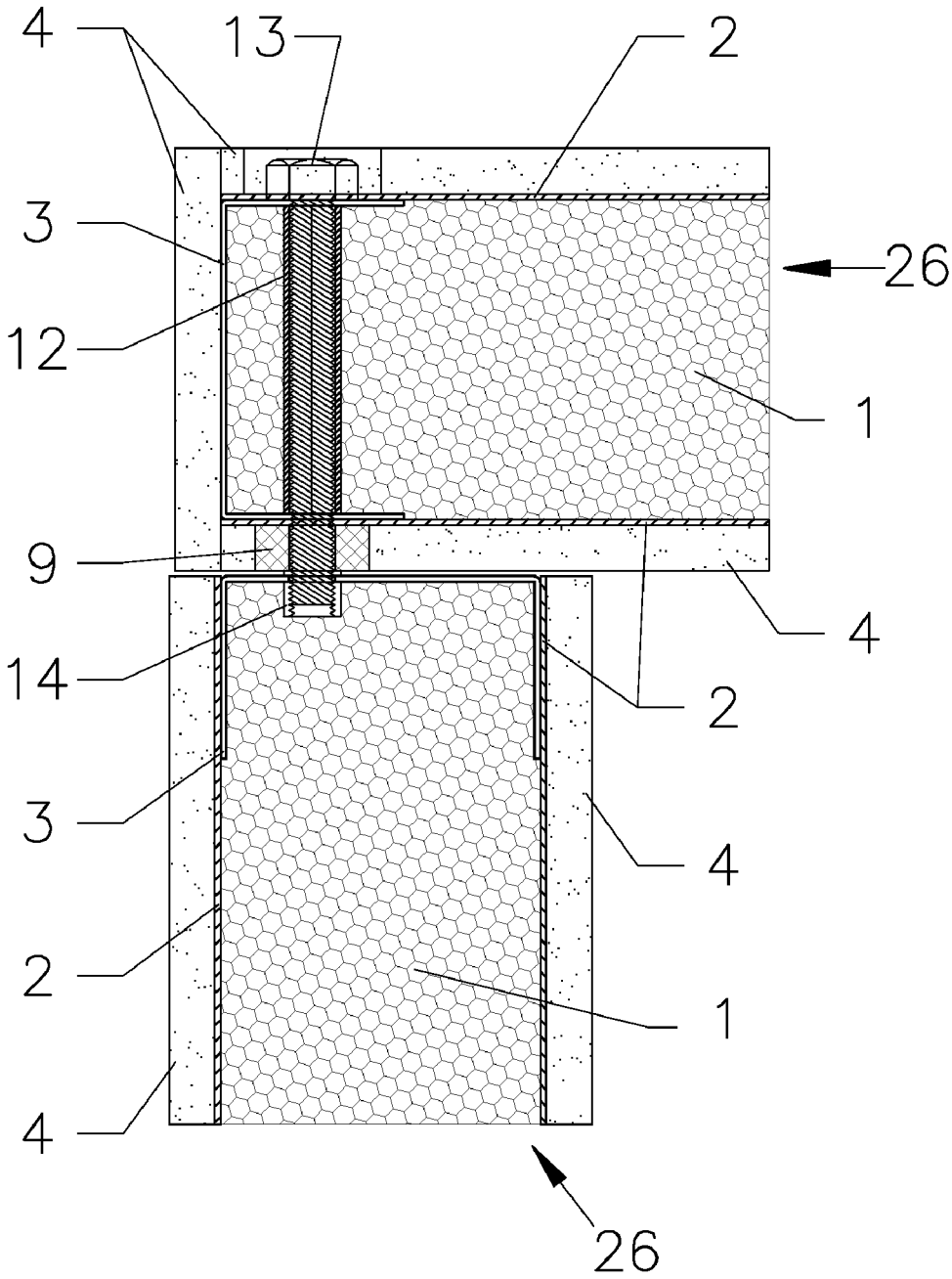
FIG. 6 is a cross section of an alternative embodiment of a "L" joint between the high-strength panels.

FIG. 3 shows one embodiment of a high-strength "T" connection of the external and internal walls 26 at a location where the exterior panel is not continuous. This connection embodiment comprises two rows of threaded fasteners 13 connected to a rivnut 14 providing a clamping force to both the outer layer and inner layer of the panel spacers 3. Over tightening the fasteners 13 could cause local buckling in the thin walls or flange of certain types of panel spacers 3, such as thin-walled cold formed steel panel spacers 3. A local failure in the panel spacer 3 could cause weakening of the wall 26. Thus, a compression sleeve 12 is used to brace the panel spacers 3 against the compression force generated by the fasteners 13. FIG. 3 shows one embodiment of a high-strength "L" corner connection of two walls 26 walls using the same method as depicted in FIG. 2 except with one row of fasteners 13 instead of two rows. In embodiments having metal components, a bonding agent 10 can be applied in areas of metal-to-metal contact to make the connection strong, leak tight, and rigid. In these embodiments, the bonding agent should be comprised of the same non-toxic resin as previously discussed in the context of the panel 25 fabrication. As shown in FIG. 4, a similar method is used for a high-strength connection between an internal wall 26 and a continuous, outside wall 26.

Where attachment strength is not critical, walls 26 may be attached together using the method shown in FIG. 5. The sheeting 4 on the wall 26 can be continuous and caulked to improve heat flow resistance. A rigid spacer 9 is added to allow fastener 13 tightening to a level that would distort or damage the panel spacers 3 or crush typical sheeting 4 material, such as sheet rock wallboard. The same high-strength connection methods for the walls 26 can be used for ceilings 27 or floor panels (not shown) attached to the internal walls 26, with the fastener spacing and quantity determined as needed to resist the design load forces. FIG. 6 shows details for one embodiment of a corner connection between two walls 26, allowing continuous sheeting 4 over the connection seam. Subsequent changes in wall arrangements can be made by made by removing the fasteners 13 from the connection seam in the walls 26 and moving the walls 26 to another location inside the structure.

Figure 7:
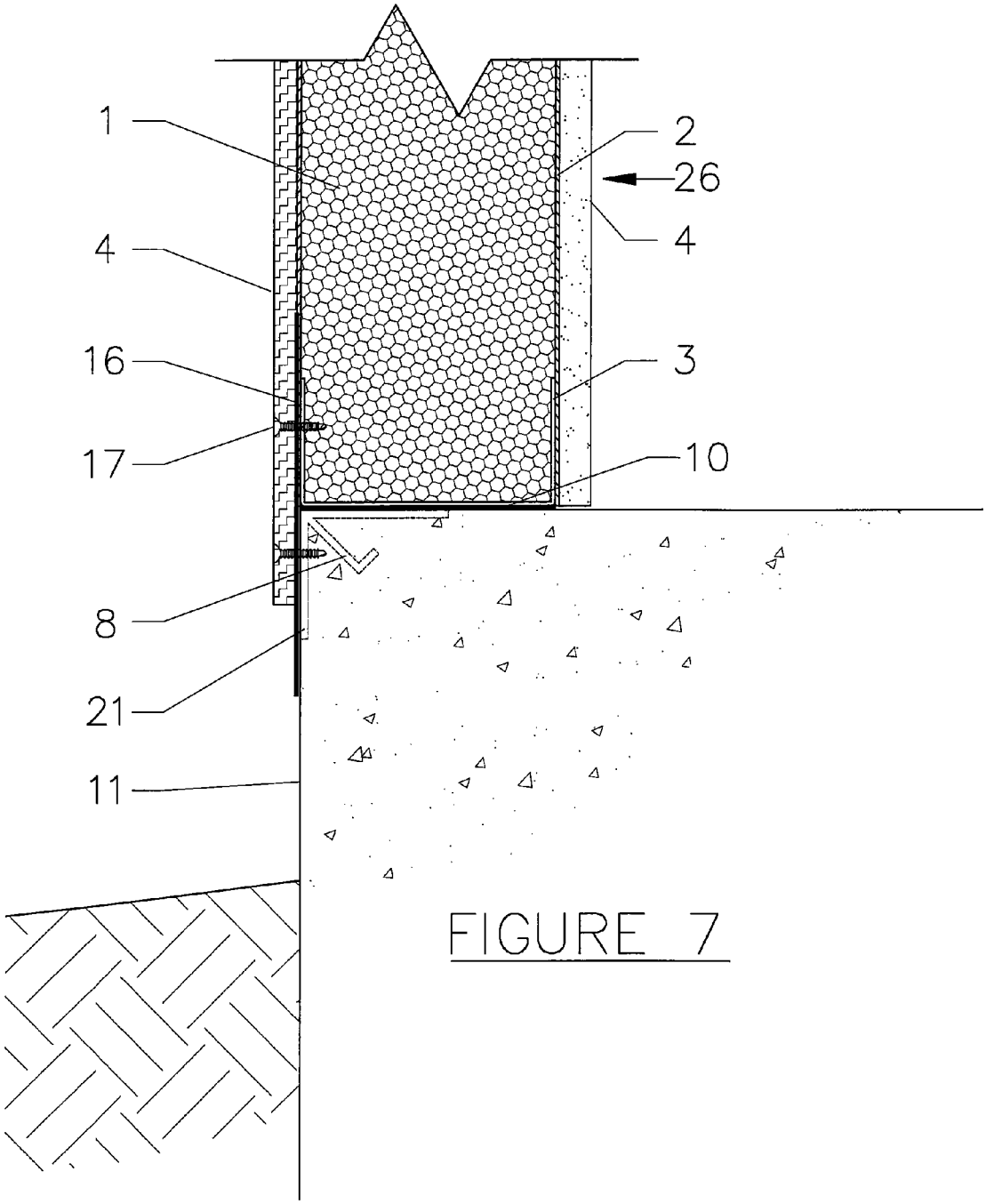
FIG. 7 is a cross section of the high-strength foundation connection.

FIG. 7 shows the watertight, high-strength foundation connection of the walls 26 to the foundation 11. This high-strength foundation connection comprises a continuous seam plate 16 with bonding agents 10, mechanical fasteners 17, and a metal bearing cap 21 having continuously spaced, angle-shaped anchor studs 8 welded to the metal bearing cap 21. When the foundation 11 is poured or cured, the bearing cap 21 is placed continuously around the edge of the uncured foundation slab 11 to assure sufficiently uniform and consistent wall to floor contact. The wall 26, which has a panel spacer 3 at the bottom of the wall, is bonded to the bearing cap 21 via the high-strength bonding agent 10. Preferably, the bonding agent 10 should also provide corrosion protection where steel is used as a panel spacer 3 in the wall 26. After the wall 26 is bonded to the bearing cap 21, the continuous seam plate 16 is placed over the wall 26 and foundation 11 and attached via mechanical fasteners 17 and additional bonding agents 10.

In many instances of extreme loading events, the foundation connection will experience uplift forces approaching 1000 pounds of uplift force per linear foot of foundation 11 perimeter. The bearing cap 21 prevents cracking at the corner of the concrete foundation 11, which can occur when conventional fasteners or anchors are placed too close the edge of the foundation. The bearing cap 21 and anchor studs 8 are capable of transferring the uplift force from the wall 26 to the foundation 11 without causing unacceptable cracking in the corner of the foundation 11. To achieve this result, the anchor studs 8 are closely, but evenly, spaced in a manner that distributes the uplift force evenly along the perimeter of the foundation 11.

In one embodiment of the high-strength foundation connection, the top part of the seam plate 16 attaches to the bottom of the panel spacer 3 that is bonded into the wall 26 by the high-strength bonding agent 10. In many applications of the foundation connection, the seam plate 16 and panel spacer 3 are made of steel, and the bonding agent 10 protects the steel from corrosive attack by the concrete. The resulting connection provides a hold down capacity of over 1500 pounds per linear foot, preventing the need for anchor bolts or rods reaching from the foundation 11 to the ceiling of the structure. The shear strength at the base of the wall 26 exceeds 2000 pounds per linear foot, exceeding the wind or seismic forces that may occur on the light weight composite structure during a 250 miles per hour wind or an 8.0 seismic event. Notably, in applications where the wall 26 and bearing cap 21 interface has about 36 square inches of bonded surface area per linear foot, the bonding agent 10 on the bearing cap 21 provides a hold-down force exceeding 7,200 pounds per linear foot.

Figure 8:
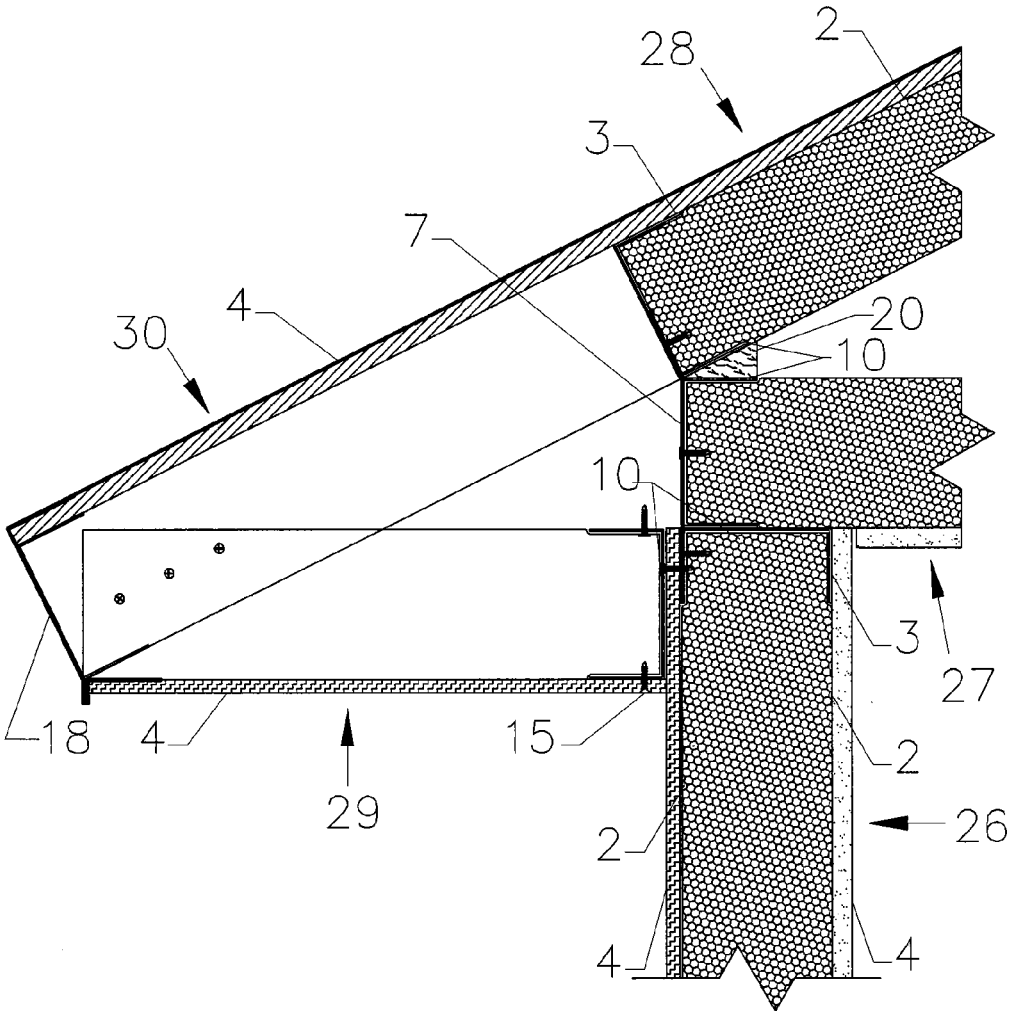
FIG. 8 shows a cross section of the high-strength eave.
Figure 9:
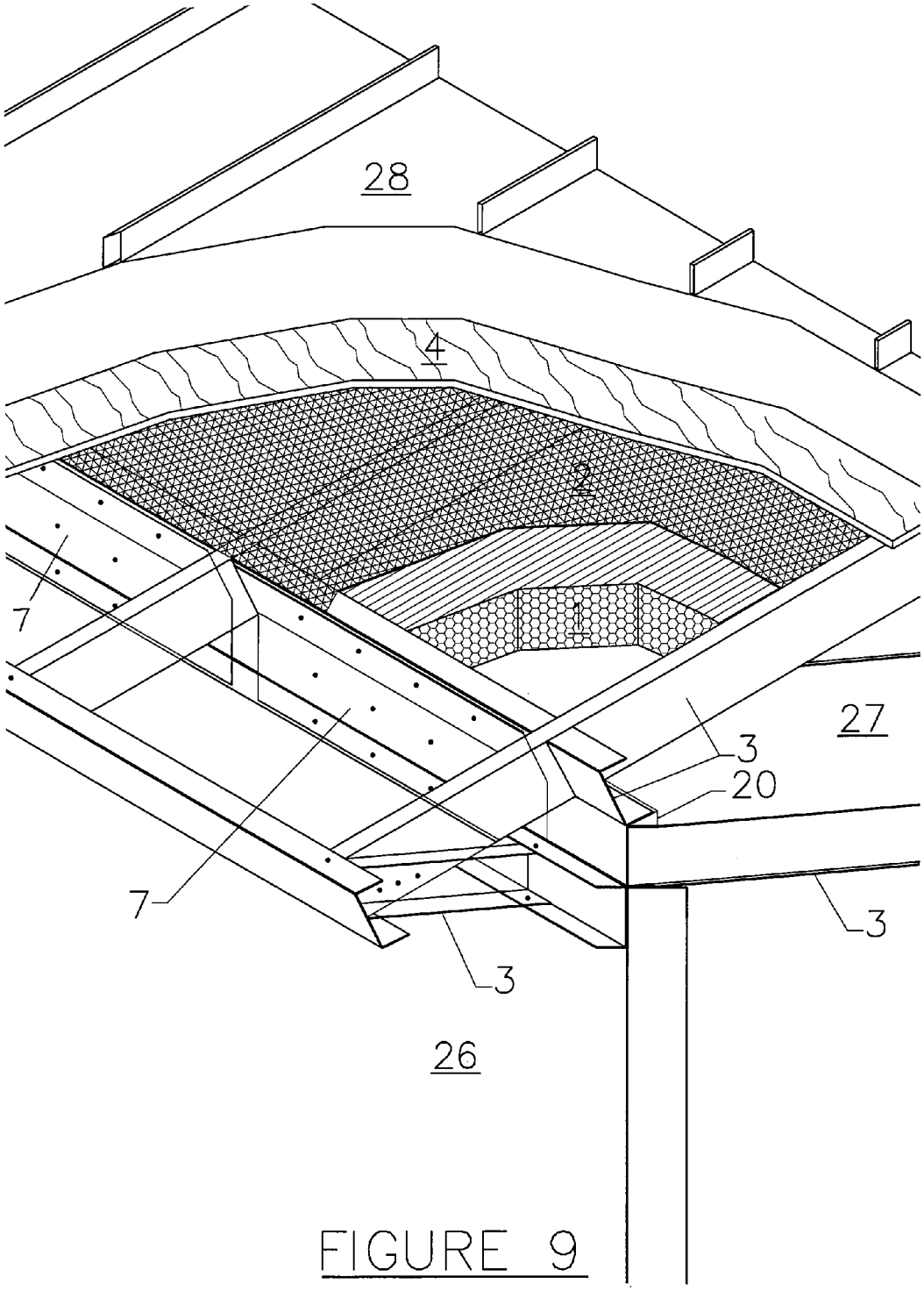
FIG. 9 shows a partial cross section of the high-strength eave connection.

The high-strength eave structure and its interface with the structure is shown in FIGS. 8 and 9. As used herein, the term "high-strength eave" is defined as an eave assembly comprising high strength composite panels. FIG. 8 provides a cross section of the connections between the high-strength eaves and the typical wall 26, ceiling 27, and roof 28 panels. The ceiling 27 panel bears on the top of the wall 26 panel, and the roof 28 panel connects to ceiling 27 via an angled connection bracket 7. A rigid wedge 20 is snugly disposed between and bonded to the ceiling 27 and roof 28 panels. The wedge 20 is bonded between these panels by the bonding agent, and the wedge 20 and plate 7 connect the wall 26 panel to both the ceiling 27 and roof 28 panels. Since the wedge 20 is continuously bonded to the ceiling 27 and roof 28 panels around the perimeter of the structure, the attic becomes a sealed, non-vented space, as described below.

The high-strength eave is comprised of a horizontal soffit 29 panel connected to an inclined eave panel 30, thus forming a triangular truss. In FIG. 8, for clarity, the soffit 29 panel is not shown, but the soffit 29 panel spacer 3*a* is indicated to show the location of the panel and connectivity of the eave truss. The interface between the soffit 29 and eave 30 panels can have a continuous sheet metal cap 18 to protect and further strengthen the soffit 29 and roof 28 panel connection and to enhance the resistance of the roof sheeting 4 to be lifted by the wind forces. The soffit 29 panel connects to the top of the wall 26, and the inclined eave 30 panel connects to the roof 28 via the inclined portion of the connection bracket 7. The connection bracket 7 provides a holding capacity of about 1000 pounds per linear foot, which is sufficient to resist uplifts under the eves caused by extreme wind and seismic forces. Uplift resistance capacity beyond 1000 pounds per linear foot can be achieved by applying a bonding agent to the interface between the structural components of each element.

In one embodiment of the high-strength eave, the steel components of the structural elements are resistance welded together to eliminate screw heads that can prevent the sheeting from having continuous contact with the steel. Continuous contact between the structural components is needed to form a continuous bond where high-strength bonding agents are used. The connection between the roof 28 and ceiling 27 panels is made by using the a polymer bonding agent to bond the structural wedge 20 to the panel spacers 3 in the roof 28 and ceiling 27 panels. The same bonding agent can be applied to the interface between the wall 26 and ceiling 27 panels. This panel integration and attaching methods increases the rigidity of the overall assembly, which enhances the performance of the roof, walls, and ceiling panels during extreme loading events.

As explained above, the bond between the wedge 20 and the ceiling 27 and roof 28 panels results in the eave and attic being non-vented to protect from pressurization of the attic and eave space. The resistance to heat flow can be improved by the insulation of all interior surfaces in the attic and dead air space. The insulation can be sealed and strengthened with the additional fibers and resins. With a non-vented attic and an insulated roof using R-24 foam and R-24 ceiling insulation and combined with the dead air space the overall "R" value of the roof/ceiling can become as high as 100. The non-vented attic has become accepted in the 2009 Florida building code.

It is known that during very high wind speeds (e.g. above 150 miles per hour), the eave vents allow pressurization of the attic, and the pressure can build under the eave to the point of causing damage or destruction of the roof 28, sheeting 4, soffit 29, or eaves 30. The pressure under the eaves can reach levels of over 100 pounds per square foot as the wind velocity pressure converts to static pressure as the wind rolls up the exterior of the wall 26. In this high-strength eave embodiment, the roof 28 connects to the wall 26 by the continuous connection bracket 7, which spans the distance between the roof 28 panel and the top of the wall 26. This connection can be made with or without mechanical fasteners 15 or high-strength bonding agents 10. Depending on the configuration, the eave can withstand 150 pounds per square foot of uplift force that results from a 250 miles per hour wind speed. This uplift force translates to a 250 pounds per linear foot uplift on the wall 26, which is resisted by the foundation connection as previously described.

Figure 10:
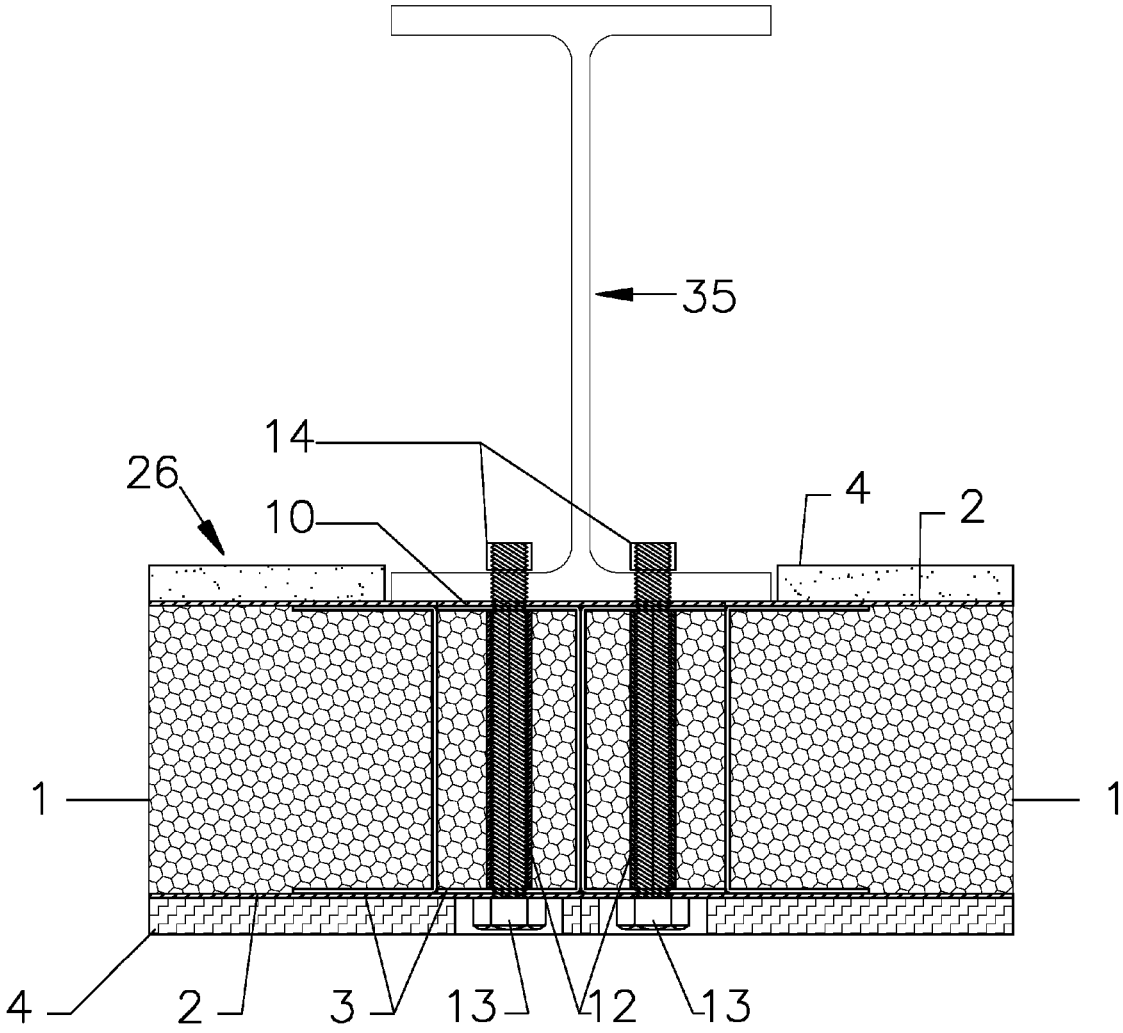
FIG. 10 is a cross section of a typical panel connected to a flanged metal column, such as in a commercial or military application of the structure.

FIG. 10 shows another embodiment of the high-strength foundation connection. The relatively high shear and bending strength of the panels 25 discreet foundation connections, such as by a column 35 attached to the wall panels 26. The column 35 can be embedded into a substructure such as earth anchors or a concrete mass. In another embodiment, these column 35 anchors can be combined with the elements of the embodiments of the high-strength foundation connection described above. The column 35 acts as an additional support against uplift and lateral impact forces, and the column 35 can be designed and sized by an ordinary practitioner for a specific structural application. External sheeting 4 may be selected from blast or impact resistant materials, as needed for military applications to protect personnel or equipment. The eve 30 can be shortened or removed to reduce uplift by blast or wind forces.

The embodiments disclosed above are merely representative of the invention and are not meant for limitation thereof. For example, an ordinary practitioner would understand that there are several commercially available substitutions for some of the features and components described above. Several embodiments described above incorporate elements that are interchangeable with the features of other embodiments. In addition, future technology developments may result in the formation or creation of new materials or elements that are equivalent to those disclosed herein. Future developments in resin and bonding agent technology are one such possible advance. It is understood that equivalents and substitutions for certain elements and components set forth above may be obvious to those having ordinary skill in the art, and therefore the true scope and definition of the invention is to be as set forth in the following claims.

I claim:

1. A high-strength structure comprising:

a plurality of high-strength, fiber reinforced panels having rigid foam core disposed between panel spacers, a fiber-reinforced membrane layer that overlays the rigid foam core, and sheeting that overlays the membrane layer, said panels forming a ceiling, a roof, and a plurality of walls supported by a foundation;

a high-strength foundation connection that securely connects the wall panels to the foundation, said foundation connection having a bearing cap embedded in the foundation and disposed continuously around the perimeter of the foundation, a wall panel bearing on the bearing cap, and a seam plate overlapping the bottom of the wall and the top of the foundation and securely connecting the wall to the foundation; and a high-strength eave having a soffit panel, an eave panel, a wall panel, a ceiling panel bearing on the top of the wall panel, a roof panel disposed at an incline above said ceiling panel, a connection bracket having a vertical leg and an inclined leg, and a rigid wedge, wherein said rigid wedge is bonded to the top of the ceiling panel and bottom of the roof panel, said vertical leg of the connection bracket is connected to the soffit panel, wall panel, and ceiling panel, and said inclined leg of the connection bracket is connected to the roof panel and eave panel, and said soffit panel and eave panel are connected to form a rigid eave truss;

wherein the fiber-reinforced membrane layer comprises a nontoxic resin having a polymer base and water as a solvent, and wherein the bearing cap further comprises anchor studs disposed continuously along the bearing cap at a substantially even spacing, and said anchor studs are capable of being embedded into the foundation, and wherein the rigid wedge is bonded by a continuous bond to the top of the ceiling panel and bottom of the roof panel, thereby providing a non-vented, sealed attic space.

2. The high-strength structure of claim 1, wherein the connection bracket is bonded by a bonding agent to the roof panel, ceiling panel, and wall panel.

3. The high-strength structure of claim 2, wherein a bonding agent is disposed between the bottom of the wall panel and the top of the bearing cap, thereby forming a continuous, water-tight seal around the perimeter of the foundation.

4. The high-strength structure of claim 2, wherein a bonding agent is disposed between the seam plate and the outside surface of the wall panel and the foundation, thereby forming a continuous, water-tight, seal around the perimeter of the foundation.

* * * * *